US007600886B1

(12) United States Patent
Sullivan et al.

(10) Patent No.: US 7,600,886 B1
(45) Date of Patent: Oct. 13, 2009

(54) BACKLIT MIRROR ASSEMBLY AND METHOD FOR USE

(75) Inventors: Daryl D. Sullivan, Las Vegas, NV (US); Robert Harney, Las Vegas, NV (US)

(73) Assignee: Cornerstone Lighting, LLC, Las Vegas, NV (US)

( * ) Notice: Subject to any disclaimer, the term of this patent is extended or adjusted under 35 U.S.C. 154(b) by 0 days.

(21) Appl. No.: 12/101,350

(22) Filed: Apr. 11, 2008

(51) Int. Cl.
*F21V 33/00* (2006.01)

(52) U.S. Cl. ..... 362/140; 362/133; 362/142; 362/222; 362/375; 312/223.5; 359/872

(58) Field of Classification Search ..... 312/223.5; 359/872; 362/133, 135, 140–142, 147, 221, 362/222, 260, 374, 375
See application file for complete search history.

(56) References Cited

U.S. PATENT DOCUMENTS 2,758,900 A * 8/1956 Marchand ..... 312/223.5
5,408,069 A 4/1995 Mischel, Jr.
5,575,552 A * 11/1996 Faloon et al. ..... 362/135
6,932,488 B1 * 8/2005 Horn ..... 362/141
2007/0159316 A1 7/2007 Mischel, Jr. et al.

* cited by examiner

*Primary Examiner*—Stephen F Husar
(74) *Attorney, Agent, or Firm*—Karen J. S. Fouts; Weiss & Moy, P.C.

(57) ABSTRACT

A backlit mirror assembly comprises a mirror, a lamp chamber, and a prop. The mirror is pivotally coupled to the lamp chamber so that it may be tilted outwardly, thereby allowing access to electrical components housed within the lamp chamber. A prop maintains the mirror in an open position. In one embodiment, the prop incorporates a gas spring to facilitate lifting of the mirror by a sole user. The mirror may be coupled to a rigid frame in order to strengthen the mirror, thereby reducing flexing of the mirror and hazards associated with such flexing.

20 Claims, 3 Drawing Sheets

BACKLIT MIRROR ASSEMBLY AND METHOD FOR USE

FIELD OF THE INVENTION

This invention relates generally to backlit mirrors and, more particularly, to a backlit mirror assembly featuring a strengthened mirror mounting that considerably reduces flexing of the mirror, and a system of pivot points that allow the mirror to be tilted outwardly, thereby allowing access to the backlit mirror's electrical components without the need for entirely removing the mirror from the assembly.

BACKGROUND OF THE INVENTION

Backlit mirrors are not a new phenomenon. As their popularity in high-end residential applications has increased, the hospitality industry has recognized that trend and incorporated backlit mirrors in the bathroom areas of their guest rooms. It is not uncommon for the backlit mirrors used in the hospitality industry to be considerably larger than those used in residential applications. For example, some backlit mirrors used in the hospitality industry may reach over nine feet in length. Initial installation of such relatively large backlit mirrors often presents substantial challenges and problems, especially when the installation is to take place in a relatively tight bathroom space. Mirror breakage and injury to those installing the mirrors often results. Even more troubling are the difficulties often encountered by maintenance personnel when they are required to access the electrical gear behind the mirrors for re-lamping or ballast replacement. It is relatively easy to chip or break the mirrors, even when several men are working carefully together to remove the mirror for access to the electrical gear.

Mirror manufacturers presently offer systems that are of two major components: a mirror with hooks attached to the back surface of the mirror, and another apparatus attached to the wall containing lamps, control gear, and reflectors. The wall component has a system of matching apparatuses so that those on the rear surface of the mirror hook into them, thereby securing the mirror in position over the light sources and to the wall surface. Removal of the mirror from the wall first requires a vertical lift to clear the hooks and then requires pulling the mirror toward the removing personnel. It is not uncommon for there to be less than one inch of clearance between the sides of the mirror and adjacent wall surfaces. These wall surfaces are frequently finished with tile or marble which will chip the mirror edges if contact is made. The mirrors and the attached hooks have almost no resistance to flexing and are prone to breakage and a risk of serious personal injury.

A need therefore exists for a backlit mirror assembly that is less prone to flexing and to risking serious personal injury of personnel installing and/or maintaining the backlit mirror assembly.

The present invention satisfies these needs and provides other, related advantages.

SUMMARY OF THE INVENTION

In accordance with one embodiment of the present invention, a backlit mirror assembly is disclosed. The backlit mirror assembly comprises, in combination: a frame coupled to a back surface of a mirror; a lamp chamber adapted to be coupled to the frame; at least one light source disposed within the lamp chamber; at least one coupling member adapted to pivotally couple the frame to the lamp chamber so that the mirror can be alternately positioned in a closed position wherein the mirror substantially covers the lamp chamber and an open position wherein the mirror is tilted away from the lamp chamber; and a prop having a first end and a second end, wherein one of the first end and second end is adapted to be coupled to the lamp chamber and the other of the first end and the second end is adapted to be coupled to the frame, wherein the prop is adapted to maintain the mirror in the open position.

In accordance with another embodiment of the present invention, a backlit mirror assembly is disclosed. The backlit mirror assembly comprises, in combination: a frame coupled to a back surface of a mirror; a lamp chamber having an open front portion and a back portion and defining a storage area therebetween, wherein the open front portion of the lamp chamber is adapted to be coupled to the frame and the back portion of the lamp chamber is adapted to be mounted to a wall; at least one light source disposed within the lamp chamber; at least one coupling member positioned proximate an upper portion of the mirror and adapted to pivotally couple the frame to the lamp chamber so that the mirror can be alternately positioned in a closed position wherein the mirror substantially covers the lamp chamber and an open position wherein the mirror is tilted away from the lamp chamber; and a gas spring prop having a first end adapted to be coupled to the lamp chamber and a second end adapted to be coupled to the frame, wherein the gas spring prop is adapted to maintain the mirror in the open position.

In accordance with a further embodiment of the present invention, a method for accessing a lamp chamber of a backlit mirror assembly is disclosed. The method comprises the steps of: providing a backlit mirror assembly comprising, in combination: a mirror; a frame coupled to a back surface of the mirror; a lamp chamber having an open front portion and a back portion and defining a storage area therebetween, wherein the open front portion of the lamp chamber is adapted to be coupled to the frame and the back portion of the lamp chamber is adapted to be mounted to a wall; at least one light source disposed within the lamp chamber; at least one coupling member positioned proximate an upper portion of the mirror and adapted to pivotally couple the frame to the lamp chamber so that the mirror can be alternately positioned in a closed position wherein the mirror substantially covers the lamp chamber and an open position wherein the mirror is tilted away from the lamp chamber; and a gas spring prop having a first end adapted to be coupled to the lamp chamber and a second end adapted to be coupled to the frame, wherein the gas spring prop is adapted to maintain the mirror in the open position; pulling a bottom portion of the mirror away from the lamp chamber; and permitting the gas spring prop to maintain the mirror in the open position.

DETAILED DESCRIPTION OF THE PREFERRED EMBODIMENTS

Figure 1:
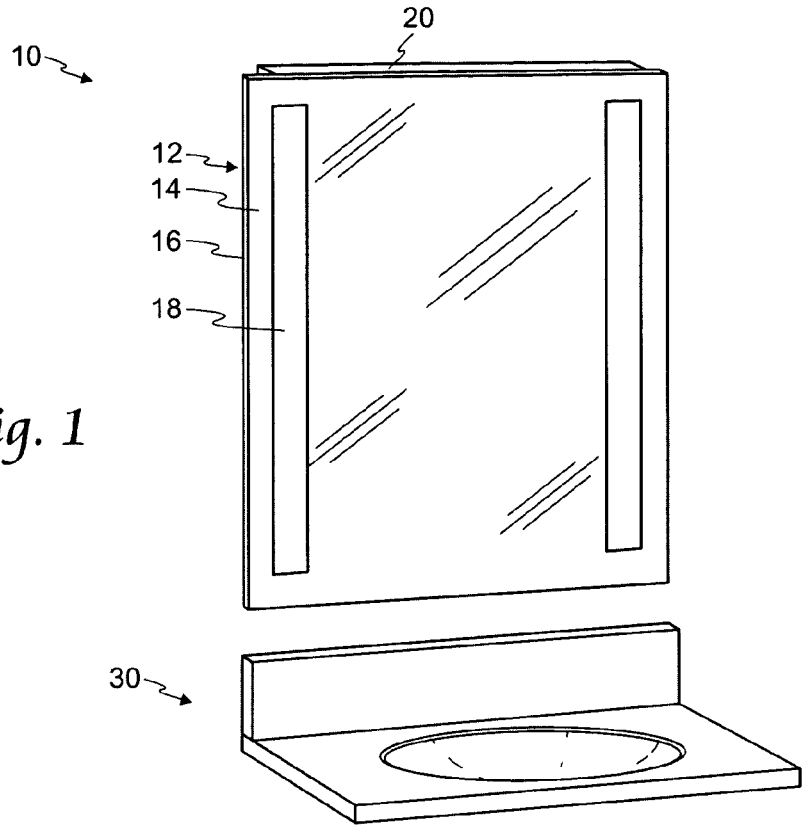
FIG. 1 is a perspective view of a backlit mirror assembly, consistent with an embodiment of the present invention.
Figure 2:
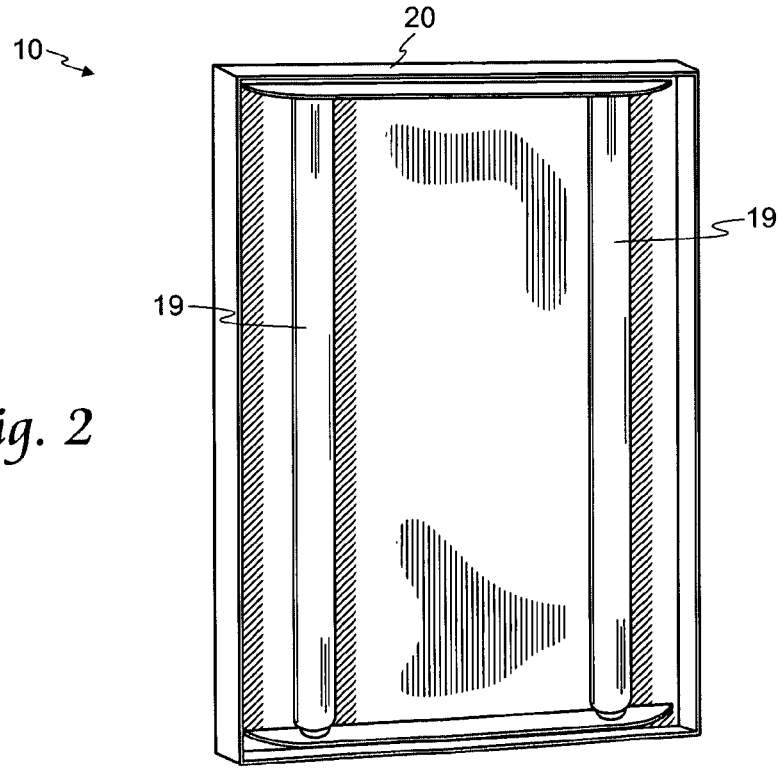
FIG. 2 is a back view of the backlit mirror assembly of FIG. 1.
Figure 3:
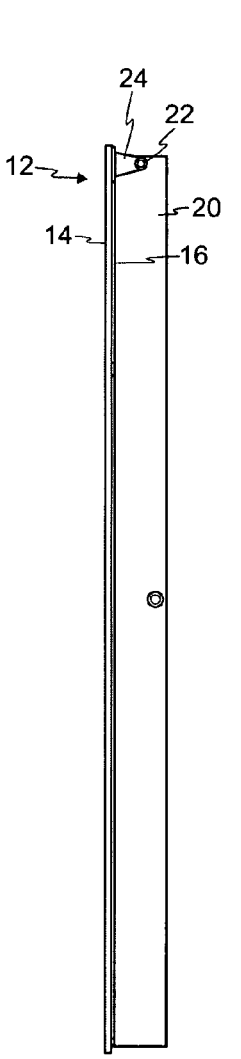
FIG. 3 is a side view of the backlit mirror assembly of FIG. 1, shown in a closed position.
Figure 4:
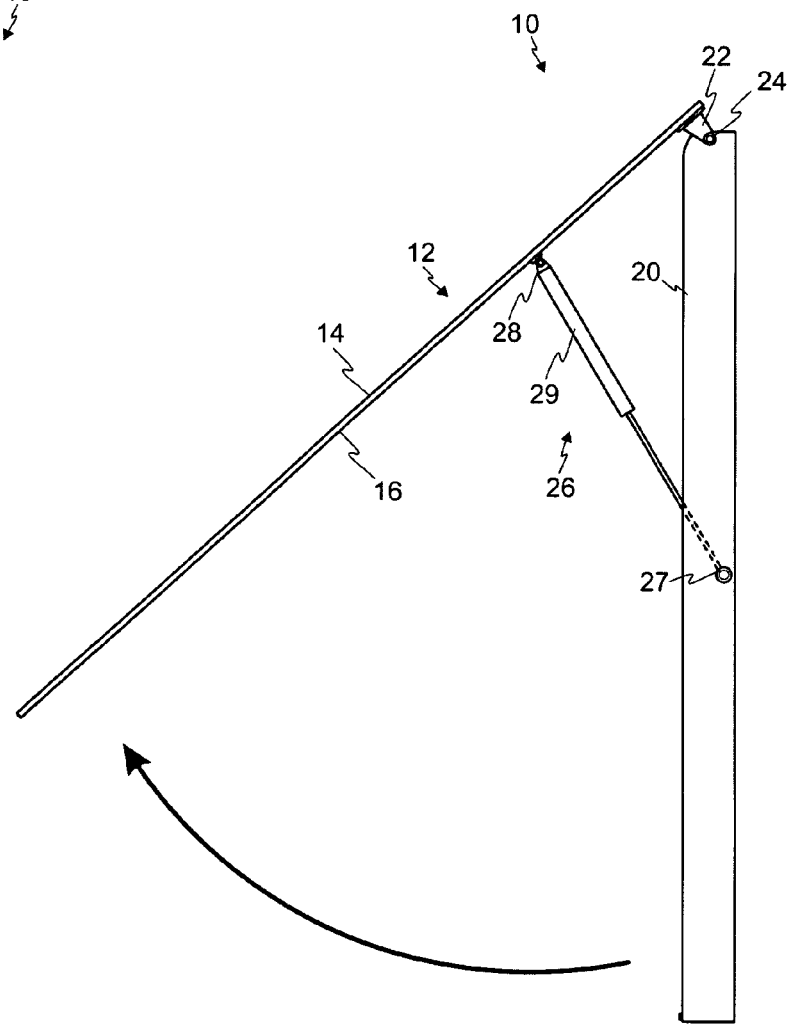
FIG. 4 is a side view of the backlit mirror assembly of FIG. 1, shown in an open position.

Referring first to FIGS. 1-4, reference number 10 refers generally to one embodiment of the backlit mirror assembly of the present invention. The backlit mirror assembly 10 is adapted to be mounted to a surface of a wall and comprises the following principal components: a mirror 12, a lamp chamber 20, and at least one prop 26 (as shown in FIG. 4). The backlit mirror assembly 10 may be placed in a variety of settings. By way of example only, and as shown in FIG. 1, the backlit mirror assembly 10 may be positioned above a sink 30.

In this embodiment, the mirror 12 includes windows 18, which permit light to emit from the lamp chamber 20 through the mirror 12 when lamps 19 (as shown in FIG. 2) or other light sources housed within the lamp chamber 20 are illuminated. Preferably, the windows 18 are flush with a front surface 14 of the mirror 12. The windows 18 may be comprised of frosted glass, if desired. Frosting of the glass may be accomplished by sandblasting. While this embodiment employs two substantially vertical windows 18 positioned proximate the sides of the mirror 12, it may be desired to alter this configuration. For example, more windows 18 could be added to the mirror 12, windows 18 could be positioned horizontally or otherwise on the mirror 12, fewer than two windows 18 could be employed, etc.

The mirror 12 may be coupled to a frame 16. In a preferred embodiment, the frame 16 is a sturdy, rigid frame and is firmly mounted to a back surface of the mirror 12. In this way, the mirror 12 may be strengthened, in order to considerably reduce flexing of the mirror 12, particularly during installation and maintenance. This may assist in substantially reducing the risk of both accidental breakage of the mirror 12 and serious personal injury to those working with the mirror 12 during such times. Preferably, the frame 16 is comprised of a rigid material, such as aluminum or some other rigid material. The frame 16 may be comprised of a 1½" by 1½" aluminum angle welded door frame.

The mirror 12, with or without the frame 16 attached thereto, is adapted to be pivotally coupled to the lamp chamber 20 through at least one pivot point 22 (as shown in FIGS. 3 and 4). In this embodiment, the mirror 12 is pivotally coupled to the lamp chamber 20 by at least one coupling member 24 positioned at pivot point 22. The coupling member 24 allows the mirror 12 to be alternately positioned in a closed position, wherein the mirror 12 substantially covers the lamp chamber 20 (as shown in FIG. 3), and an open position, wherein the mirror 12 is tilted away from the lamp chamber 20 (as shown in FIG. 4). The coupling member 24 may consist of, for example, a hinge, pivotable fastener, shoulder bolt, or the like. Preferably, a pair of pivot points 22 and a pair of coupling members 24 are employed, so that there is added support for the mirror 12 when it is coupled to the lamp chamber 20. Preferably, the pivot points 22 are positioned at or near an upper portion of the mirror 12. In this way, when the mirror 12 is tilted outwardly (as further discussed below), the upper portion of the mirror 12 should not be obstructed by either the top of the lamp chamber 20 or a wall to which the backlit mirror assembly 10 is adapted to be mounted.

The lamp chamber 20, in the embodiment shown in FIGS. 1-4, comprises a receptacle having an open front portion proximate the mirror 12, a back portion, and defines a storage area therebetween. The lamp chamber 20 is adapted to house at least one lamp 19 or other light source as well as any electrical gear or components (not shown) that may be required for the at least one lamp 19 or other light source. In addition, the lamp chamber 20 serves as a storage area for the prop 26 and conceals the prop 26 when the mirror 12 is in a closed position. The back portion of the lamp chamber 20 is adapted to be mounted to a wall. Preferably, the lamp chamber 20 is composed of a relatively heavy-duty material, such as steel or aluminum, but could be composed of some other desired material, so long as it is capable of safely supporting the weight of the mirror 12.

Turning specifically to FIG. 4, the prop 26 has a first end 27 coupled to the lamp chamber 20 and a second end 28 coupled to the frame 16 of the mirror 12. In this preferred embodiment, the prop 26 includes a gas spring 29. When the prop 26 is properly calibrated and mounted, the gas spring 29 allows a sole user to open the backlit mirror assembly 10 by pulling a bottom portion of the mirror 12 away from the lamp chamber 20. A user may accomplish this with one hand, as the mirror 12 will preferably tilt upward and out of the way with the aid of the gas spring 29. The mirror 12 may be held in this tilted position while the user accesses the lamp 19, other light source, or electrical gear (not shown) that may be housed within the lamp chamber 20 and performs any necessary maintenance. When the user has completed any necessary maintenance, the user may merely pull gently downward on the mirror 12 and lock it in place in a closed position. To assist with locking the mirror 12 in place, it may be desired to employ one or more spring-loaded latches (not shown), which may be mounted near a bottom portion of the frame 16. The angle at which the prop 26 holds the mirror 12 open depends upon a number of factors, including the mounting position of the prop 26, and stroke length and force of the gas spring 29, and may be adjusted according to a user's particular preference.

Preferably, the backlit mirror assembly 10 includes means by which the mirror frame and mirror 12 may be removed without the use of tools if replacement of the mirror 12 is required.

Figure 5:
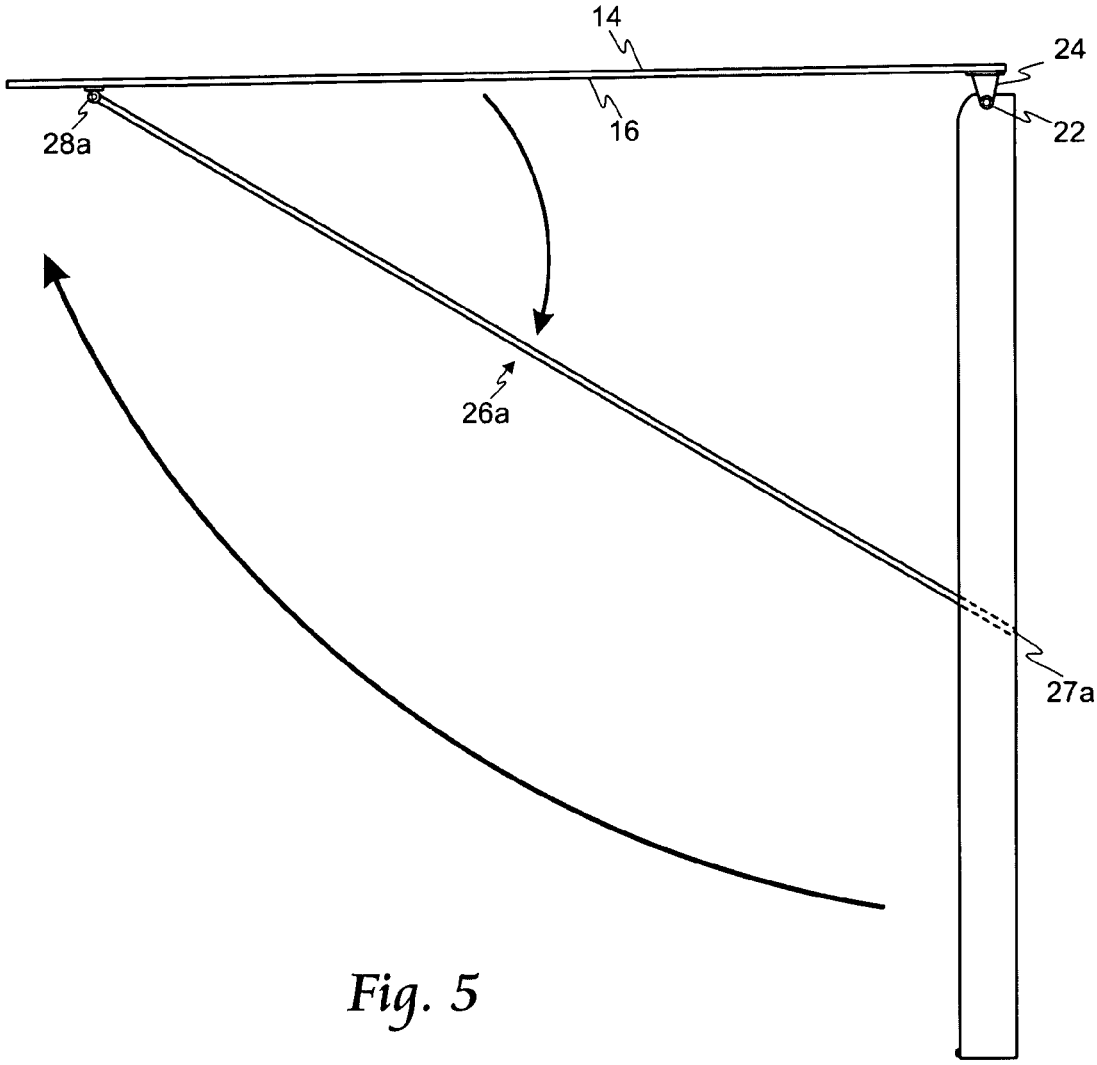
FIG. 5 is a side view of a backlit mirror assembly, consistent with an embodiment of the present invention, shown in an open position.

Referring now to FIG. 5, an alternative embodiment of the prop 26, hereinafter prop **26*a*, is shown. The prop 26*a* performs the same function as the prop 26, in that it maintains the mirror 12 in an open position. In this embodiment, the prop 26*a* is a simple prop device similar to those used to prop open the hoods of relatively older model automobiles. The prop 26*a* includes a first end 27*a* that may be removably coupled to the lamp chamber 20, and a second end 28*a* coupled to the frame 16. Preferably, in this embodiment, the lamp chamber 20 includes a receptacle or notch adapted to receive the first end 27*a* of the prop 26*a* in order that the prop 26*a* may be held in place when it is maintaining the mirror 12 in an open position. When the prop 26*a* is not in use, it may be concealed within the lamp chamber 20. In this embodiment, a person opening the backlit mirror assembly 10 would be required to first lift the mirror 12 and then hold it while placing the prop 26*a* in position. Depending upon the weight and dimensions of the mirror 12, the task of lifting and holding the mirror 12** may require more than one individual, and perhaps three or more individuals, in order to be accomplished safely. This is still considerably safer than trying to remove the mirror entirely and then having to re-hang it.

While the invention has been particularly shown and described with reference to preferred embodiments thereof, it will be understood by those skilled in the art that the foregoing and other changes in form and details may be made therein without departing from the spirit and scope of the invention.

We claim:

1. A backlit mirror assembly comprising, in combination:

a frame coupled to a back surface of a mirror;

a lamp chamber adapted to be coupled to the frame;

at least one light source disposed within the lamp chamber;

at least one coupling member adapted to pivotally couple the frame to the lamp chamber so that the mirror can be alternately positioned in a closed position wherein the mirror substantially covers the lamp chamber and an open position wherein the mirror is tilted away from the lamp chamber; and a prop having a first end and a second end, wherein one of the first end and second end is adapted to be coupled to the lamp chamber and the other of the first end and the second end is adapted to be coupled to the frame, wherein the prop is adapted to maintain the mirror in the open position.

2. The backlit mirror assembly of claim 1, further comprising a mirror.

3. The backlit mirror assembly of claim 2, wherein the at least one coupling member is positioned proximate an upper portion of the mirror.

4. The backlit mirror assembly of claim 2, wherein the mirror defines at least one window dimensioned to permit light from the at least one light source to pass therethrough.

5. The backlit mirror assembly of claim 2 comprising two light sources disposed within the lamp chamber.

6. The backlit mirror assembly of claim 5, wherein the mirror defines two windows, wherein each window is dimensioned to permit light from one of the two light sources to pass therethrough.

7. The backlit mirror assembly of claim 1, wherein the at least one coupling member is one of a hinge, pivotable fastener, and shoulder bolt.

8. The backlit mirror assembly of claim 1, wherein the prop comprises a gas spring prop.

9. A backlit mirror assembly comprising, in combination:

a frame coupled to a back surface of a mirror;

a lamp chamber having an open front portion and a back portion and defining a storage area therebetween, wherein the open front portion of the lamp chamber is adapted to be coupled to the frame and the back portion of the lamp chamber is adapted to be mounted to a wall;

at least one light source disposed within the lamp chamber;

at least one coupling member positioned proximate an upper portion of the mirror and adapted to pivotally couple the frame to the lamp chamber so that the mirror can be alternately positioned in a closed position wherein the mirror substantially covers the lamp chamber and an open position wherein the mirror is tilted away from the lamp chamber; and a gas spring prop having a first end adapted to be coupled to the lamp chamber and a second end adapted to be coupled to the frame, wherein the gas spring prop is adapted to maintain the mirror in the open position.

10. The backlit mirror assembly of claim 9, further comprising a mirror.

11. The backlit mirror assembly of claim 10, wherein the mirror defines at least one window dimensioned to permit light from the at least one light source to pass therethrough.

12. The backlit mirror assembly of claim 10 comprising two light sources disposed within the lamp chamber.

13. The backlit mirror assembly of claim 12, wherein the mirror defines two windows, wherein each window is dimensioned to permit light from one of the two light sources to pass therethrough.

14. The backlit mirror assembly of claim 9, wherein the at least one coupling member is one of a hinge, pivotable fastener, and shoulder bolt.

15. A method for accessing a lamp chamber of a backlit mirror assembly, comprising the steps of:

providing a backlit mirror assembly comprising, in combination:

a mirror;

a frame coupled to a back surface of the mirror;

a lamp chamber having an open front portion and a back portion and defining a storage area therebetween, wherein the open front portion of the lamp chamber is adapted to be coupled to the frame and the back portion of the lamp chamber is adapted to be mounted to a wall;

at least one light source disposed within the lamp chamber;

at least one coupling member positioned proximate an upper portion of the mirror and adapted to pivotally couple the frame to the lamp chamber so that the mirror can be alternately positioned in a closed position wherein the mirror substantially covers the lamp chamber and an open position wherein the mirror is tilted away from the lamp chamber; and a gas spring prop having a first end adapted to be coupled to the lamp chamber and a second end adapted to be coupled to the frame, wherein the gas spring prop is adapted to maintain the mirror in the open position;

pulling a bottom portion of the mirror away from the lamp chamber; and permitting the gas spring prop to maintain the mirror in the open position.

16. The method of claim 15, wherein the at least one coupling member is one of a hinge, pivotable fastener, and shoulder bolt.

17. The method of claim 15, wherein the mirror defines at least one window dimensioned to permit light from the at least one light source to pass therethrough.

18. The method of claim 15, wherein the backlit mirror assembly comprises two light sources disposed within the lamp chamber.

19. The method of claim 18, wherein the mirror defines two windows, wherein each window is dimensioned to permit light from one of the two light sources to pass therethrough.

20. The method of claim 15, wherein the lamp chamber is comprised of one of steel and aluminum.

* * * * *